US010172442B2

(12) United States Patent
Wu et al.

(10) Patent No.: US 10,172,442 B2
(45) Date of Patent: Jan. 8, 2019

(54) ORAL CARE IMPLEMENT

(71) Applicant: COLGATE-PALMOLIVE COMPANY, New York, NY (US)

(72) Inventors: Donghui Wu, Bridgewater, NJ (US); David Kyung Min Lee, East Brunswick, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/504,453

(22) PCT Filed: Aug. 18, 2014

(86) PCT No.: PCT/US2014/051481
§ 371 (c)(1),
(2) Date: Feb. 16, 2017

(87) PCT Pub. No.: WO2016/028258
PCT Pub. Date: Feb. 25, 2016

(65) Prior Publication Data

US 2017/0238688 A1 Aug. 24, 2017

(51) Int. Cl.
*B43K 5/02* (2006.01)
*A46B 11/00* (2006.01)
(Continued)

(52) U.S. Cl.
CPC ..... *A46B 11/0041* (2013.01); *A46B 5/026* (2013.01); *A46B 11/002* (2013.01);
(Continued)

(58) Field of Classification Search
CPC ..... A46B 11/002; A46B 2200/1066
(Continued)

(56) References Cited

U.S. PATENT DOCUMENTS 4,963,046 A 10/1990 Eguchi
5,918,995 A 7/1999 Puurunen
(Continued)

FOREIGN PATENT DOCUMENTS

CN 2540829 Y 3/2003
CN 201312627 Y 9/2009
(Continued)

OTHER PUBLICATIONS

International Search Report and the Written Opinion of the International Searching Authority issued in international application PCT/US2014/051481 dated May 12, 2015.

*Primary Examiner* — Jennifer C Chiang

(57) ABSTRACT

An oral care implement including a body comprising a handle, a head at an end of the handle, and at least one fluid outlet, the head having at least one oral care element extending therefrom; a reservoir, in the body, for storing an oral care fluid; and a pump for pumping the oral care fluid from the reservoir towards the fluid outlet, wherein the pump comprises a first check valve downstream of the reservoir, and a second check valve downstream of the first check valve and upstream of the fluid outlet. One of the first and second check valves comprises a valve seat defining an opening through which the oral care fluid is flowable, a valve member separate from the valve seat and comprising a stopper movable linearly relative to the valve seat, and a resilient element separate from the valve member and biasing the stopper towards the valve seat.

19 Claims, 7 Drawing Sheets

(51) Int. Cl.
*B05B 11/00* (2006.01)
*A46B 5/02* (2006.01)

(52) U.S. Cl.
CPC ..... *A46B 11/0058* (2013.01); *A46B 11/0065* (2013.01); *A46B 11/0086* (2013.01); *B05B 11/3032* (2013.01); *B05B 11/3069* (2013.01); *A46B 2200/1066* (2013.01)

(58) Field of Classification Search
USPC ..... 401/188 R
See application file for complete search history.

(56) References Cited

U.S. PATENT DOCUMENTS

| | | | | |
|---|---|---|---|---|
| 6,948,875 | B1 * | 9/2005 | Jang | A46B 11/0058 401/146 |
| 8,037,899 | B2 | 10/2011 | Masaharu et al. | |
| 8,087,843 | B2 * | 1/2012 | Ottaviani | A46B 11/0041 15/22.1 |
| 8,561,638 | B2 | 10/2013 | Kosei | |
| 2007/0041779 | A1 | 2/2007 | Kuo | |
| 2010/0284726 | A1 | 11/2010 | Ottaviani et al. | |
| 2011/0070016 | A1 | 3/2011 | Richardson | |
| 2012/0301209 | A1 | 11/2012 | Fattori | |
| 2013/0308994 | A1 | 11/2013 | Wu | |

FOREIGN PATENT DOCUMENTS

| | | |
|---|---|---|
| CN | 201315977 Y | 9/2009 |
| CN | 203137444 | 8/2013 |
| GB | 2291799 | 2/1996 |
| WO | 2009/008823 | 1/2009 |
| WO | 2009/024024 | 2/2009 |

* cited by examiner

ORAL CARE IMPLEMENT

BACKGROUND

The present invention relates to oral care implements, such as toothbrushes, having a pump for pumping an oral care fluid to a fluid outlet.

It is known to provide an oral care implement, such as a toothbrush, with a reservoir storing an oral care fluid and a pump for feeding the fluid to a fluid outlet, such as at a head of the implement. One such known oral care implement has a diaphragm pump for pumping oral care fluid from a reservoir to a fluid outlet, which diaphragm pump has a pair of flap valves controlling fluid flow through a chamber of variable volume between the flap valves. The material from which flap valves are made can deteriorate over time, particularly if subjected to high temperatures, leading to poor operation or failure of the valves. Another such known oral care implement has a pump device comprising two valves, each comprising a movable, unattached spherical valve member. However, the spherical valve members would not reliably control fluid flow through the valves.

There is a need for an oral care implement, such as a toothbrush, with a more robust and more reliable pump mechanism for pumping oral care fluid from a reservoir towards a fluid outlet.

BRIEF SUMMARY

A first aspect of the present invention provides a first oral care implement, comprising: a body comprising a handle, a head at an end of the handle, and at least one fluid outlet, the head having at least one oral care element extending therefrom; a reservoir, in the body, for storing an oral care fluid; and a pump for pumping the oral care fluid from the reservoir towards the fluid outlet, wherein the pump comprises a first check valve downstream of the reservoir, and a second check valve downstream of the first check valve and upstream of the fluid outlet; wherein one of the first and second check valves comprises a valve seat defining an opening through which the oral care fluid is flowable, a valve member separate from the valve seat and comprising a stopper movable linearly relative to the valve seat, and a resilient element biasing the stopper towards the valve seat to restrict fluid flow through the opening.

Optionally, the resilient element is unitary with the valve member, or the resilient element is separate from the valve member.

A second aspect of the present invention provides a second oral care implement, comprising: a body comprising a handle, a head at an end of the handle, and at least one fluid outlet, the head having at least one oral care element extending therefrom; a reservoir, in the body, for storing an oral care fluid; and a pump for pumping the oral care fluid from the reservoir towards the fluid outlet, wherein the pump comprises a first check valve downstream of the reservoir, and a second check valve downstream of the first check valve and upstream of the fluid outlet; wherein one of the first and second check valves comprises a valve seat defining an opening through which the oral care fluid is flowable, a valve member comprising a stopper movable relative to the valve seat, and a resilient element separate from the valve member and biasing the stopper towards the valve seat to restrict fluid flow through the opening.

Optionally, the valve member is separate from the valve seat.

Optionally, the stopper is movable linearly relative to the valve seat.

Optionally, in either one of the first and second oral care implements, the valve member comprises a stem extending from the stopper and movably located in the opening. Further optionally, the stem is unitary with the stopper.

Optionally, in either one of the first and second oral care implements, the stopper is resilient and/or flexible.

Optionally, in either one of the first and second oral care implements, the stopper comprises a plug for plugging the opening.

Optionally, in either one of the first and second oral care implements, the valve seat and a perimeter of the stopper are of the same shape.

Optionally, in either one of the first and second oral care implements, one or each of the valve seat and a perimeter of the stopper is circular.

Optionally, in either one of the first and second oral care implements, the resilient element comprises a compression spring.

Optionally, in either one of the first and second oral care implements, the resilient element comprises a helical spring.

Optionally, in either one of the first and second oral care implements, the valve seat is defined by a surface of the body.

Optionally, in either one of the first and second oral care implements, one of the first and second check valves comprises a casing within which the stopper and resilient element are located.

Optionally, an end of the resilient element abuts a surface of the casing. Further optionally, the surface of the casing is in a recess in the casing.

Optionally, the valve seat is defined by the casing.

Optionally, the casing is non-unitary with the body and is located within the body.

Optionally, the casing comprises a first casing part and a second casing part attached to the first casing part so as to encase the stopper and the resilient element in the casing. Further optionally, the first casing part defines the valve seat and an end of the resilient element abuts a surface of the second casing part.

Optionally, in either one of the first and second oral care implements, the pump comprises a chamber of variable volume downstream of the first check valve and upstream of the second check valve.

Optionally, in either one of the first and second oral care implements, the pump comprises a diaphragm pump.

Optionally, either one of the first and second oral care implements comprises a thumb grip surface on the handle, and the thumb grip surface is movable relative to the body to cause operation of the pump. Further optionally, the pump comprises a diaphragm pump, and the thumb grip surface is operably connected to a movable diaphragm, or the thumb grip surface is a surface of a movable diaphragm.

Optionally, in either one of the first and second oral care implements, the other of the first and second check valves comprises a second valve seat defining a second opening through which the oral care fluid is flowable, a second valve member comprising a second stopper, and a second resilient element biasing the second stopper towards the second valve seat to restrict fluid flow through the second opening. Further optionally, the one of the first and second check valves is the first check valve, the other of the first and second check valves is the second check valve, and a spring constant of the resilient element of the first check valve is less than a spring constant of the second resilient element of the second check valve.

Optionally, the second valve member is separate from the second valve seat.

Optionally, the second stopper is movable linearly relative to the second valve seat.

Optionally, the second stopper has a free edge along a full perimeter of the second stopper.

Optionally, in either one of the first and second oral care implements, a spring constant of the resilient element of the first check valve is at least 10 N/m; optionally at least 25 N/m; further optionally at least 50 N/m; further optionally at least 75 N/m; still further optionally at least 100 N/m.

Optionally, in either one of the first and second oral care implements, the oral care fluid is stored in the reservoir.

Optionally, in either one of the first and second oral care implements, the reservoir is in the handle.

Optionally, in either one of the first and second oral care implements, the reservoir is comprised in the body and forms a portion, or all, of the handle.

Optionally, in either one of the first and second oral care implements, the reservoir is detachably connected to the body.

Optionally, in either one of the first and second oral care implements, the reservoir is transparent or translucent.

Optionally, in either one of the first and second oral care implements, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof.

Optionally, in either one of the first and second oral care implements, the oral care implement comprises a toothbrush.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

In the following description, each of the exemplary embodiments of the oral care implement of the invention comprises a manually-operated oral care implement, more specifically a manually-operated toothbrush. However, in variations to these embodiments, the oral care implement could instead comprise a powered oral care implement, such as a powered toothbrush, wherein one or more oral care elements provided to the head of the implement are drivable so as to be moved relative to the handle of the implement. In still further embodiments, the oral care implement could instead comprise other forms of oral care implement, such as a soft-tissue cleaner, a tooth polisher, an interdental brush, a tongue scraper, or another implement designed for oral care. It is to be understood that other embodiments may be utilised, and that structural and functional modifications may be made without departing from the scope of the present invention.

Figure 1:
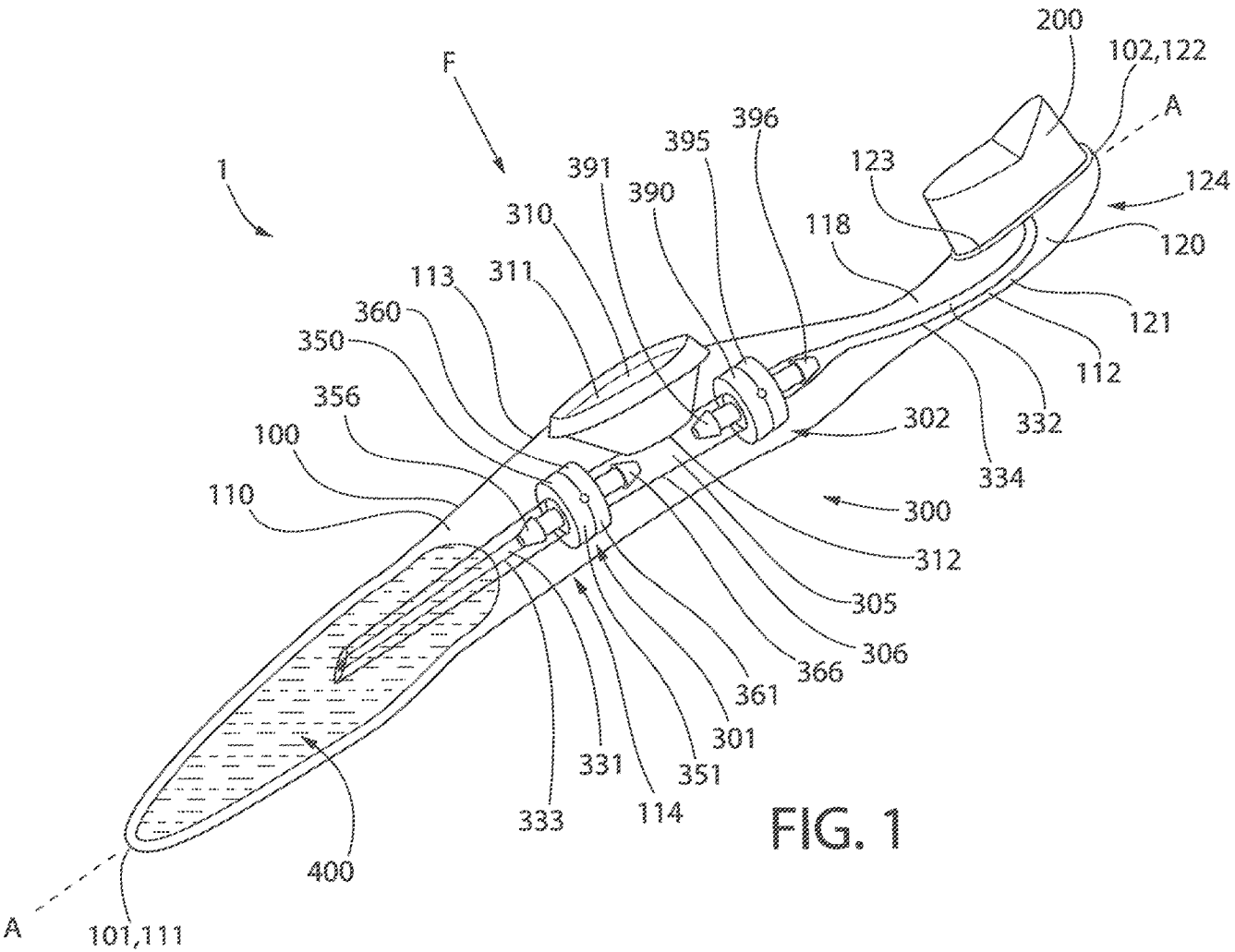
FIG. 1 shows a perspective view of an oral care implement according to an exemplary embodiment of the present invention.
Figure 2:
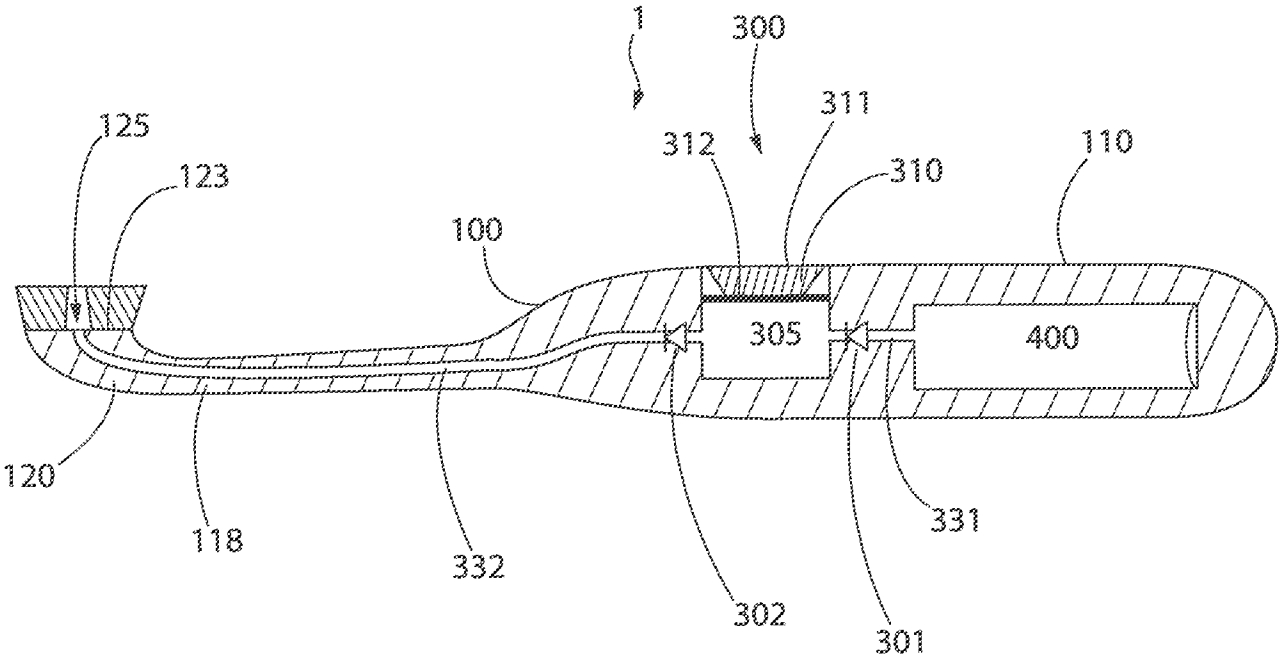
FIG. 2 shows a schematic diagram of the oral care implement of FIG. 1.

FIGS. 1 and 2 illustrate an oral care implement, in this case a toothbrush, according to an exemplary embodiment of the present invention, generally designated with the reference numeral 1. As viewed from the exterior, the toothbrush 1 generally comprises a body 100, oral care elements 200 and a fluid outlet 125 on a head 120 of the body 100, and a user-operable actuator 310 of a pump 300 on a handle 110 of the body 100.

The body 100 of the toothbrush 1 has a proximal end 101 and a distal end 102 and is elongate between the proximal and distal ends 101, 102. The body 100 comprises the handle 110 and the head 120 at a distal end 112 of the handle 110. The head 120 is a distal portion of the body 100 and has a proximal end 121 and a distal end 122, which distal end 122 forms the distal end 102 of the body 100. The head 120 has extending therefrom the oral care elements 200 for cleaning or polishing surfaces in a user's mouth, such as surfaces of their teeth.

The oral care elements 200 extend from a first, front side of the toothbrush 1, more specifically from a first, front side 123 of the head 120, and are for cleaning or polishing surfaces in a user's mouth, such as surfaces of their teeth. As used herein, the term "oral care element" is used in a generic sense to refer to any structure that can be used to clean, massage or polish an oral surface, such as teeth or soft tissue, through relative surface contact. In this embodiment, the oral care elements comprise a plurality of tooth cleaning elements, preferably a plurality of flexible bristles arranged in tufts. However, in variations to this embodiment, the oral care elements may additionally or alternatively comprise one or more tooth polishing elements, preferably in the form of elastomeric tooth polishing elements, such as elastomeric protrusions, elements, fingers, or prophylactic (prophy) cups. In some embodiments, the oral care elements 200 may comprise at least one of any one or more of the following, without limitation: bristles, rigid bristles, flexible bristles, filament bristles, fibre bristles, nylon bristles, polybutylene terephthalate (PBT) bristles, tapered bristles, spiral bristles, rubber bristles, elastomeric protrusions, elastomeric elements, flexible polymer protrusions, co-extruded filaments, flag bristles, crimped bristles, anti-bacterial bristles and combinations thereof and/or structures containing such materials or combinations. Although the oral care fluid is stored in the reservoir 400 in the illustrated embodiment, in variations to the illustrated embodiment the toothbrush 1 may be supplied with the reservoir 400 free of oral care fluid and fillable with the oral care fluid after purchase.

The head 120 also comprises the fluid outlet 125 at the first, front side 123 of the head 120. The fluid outlet 125 will be described in more detail below. In a variation to the illustrated embodiment, a soft tissue cleaner may be provided on a second side of the toothbrush 1, such as a second, rear side of the toothbrush 1 opposite to the front side of the toothbrush 1. Such a soft tissue cleaner may be provided on a second, rear side 124 of the head 120.

The handle 110 is a proximal portion of the body 100 and has the distal end 112 and a proximal end 111, which proximal end 111 forms the proximal end 101 of the body 100. The handle 110 includes a neck portion 118 by which the handle 110 is connected with the head 120. The neck portion 118 is generally of a smaller cross sectional area than the rest of the handle 110. The neck portion 118 includes the distal end 112 of the handle 110, which is that portion of the handle 110 fixed to and closest to the proximal end 121 of the head 120. In the illustrated embodiment, the head 120 is non-detachable from the handle 110. However, in variations to the illustrated embodiment, the head 120 may be detachable from the handle 110, such as for replacement of the head 110 when the oral care elements 200 become worn.

The handle 110 provides a user with a mechanism by which he/she can readily grip and manipulate the toothbrush 1, includes ergonomic features which provide a high degree of control for the user while maintaining comfort, and may be formed of many different shapes and with a variety of constructions. Although the handle 110 is a non-linear structure in the illustrated embodiment, the invention is not so limited, and in certain embodiments the toothbrush 1 may have a simple linear handle 110.

The toothbrush 1 comprises a reservoir 400 in the handle 110 of the body 100. In the illustrated embodiment, the reservoir 400 is comprised in a vessel formed from a plastic, such as a thermoplastic polymer, e.g. polyethylene terephthalate (PET) or polypropylene (PP), is housed inside the body 100 of the toothbrush 1, and is visible from the exterior of the toothbrush 1, since the body 100 in this embodiment is transparent or translucent. The reservoir 400 is translucent or transparent, so that a user can view the contents of the reservoir 400. In variations to the illustrated embodiment, the material from which the body 100 is made is opaque. One or more windows may be provided in such an opaque body 100, so that the reservoir 400 and its contents are visible from the exterior of the toothbrush 1. In further embodiments, the body 100 comprises the reservoir 400 and the reservoir 400 forms a portion, or all, of the handle 110. In some embodiments, the reservoir 400 is detachably connected to the body 100 and may be replaceable or disposable.

Preferably, the oral care fluid comprises one or more oral care agents. Any suitable oral care agent(s) can be used in the present invention. In the illustrated embodiment, the oral care fluid is a mouthwash comprising one or more antibacterial agents, flavors or flavor ingredients, and breath freshening ingredients. However, in variations to the illustrated embodiment, the oral care fluid comprises one or more oral care agents selected from the group consisting of: antibacterial agents; oxidative or whitening agents; enamel strengthening or repair agents; tooth erosion preventing agents; tooth anti-sensitivity ingredients; gum health actives; nutritional ingredients; tartar control or anti-stain ingredients; enzymes; sensate ingredients; caries or plaque disclosing agents; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In some embodiments, the oral care fluid comprises more than one of the oral care agents listed in the preceding sentence. The oral care fluid preferably is free of (i.e., is not) toothpaste. Preferably, the oral care fluid is intended to provide supplemental oral care benefits in addition to merely brushing one's teeth. The oral care fluid preferably is a liquid.

The toothbrush 1 also comprises the pump 300 in the body 100. The pump 300 is for pumping the oral care fluid from the reservoir 400 in the handle 110 to the fluid outlet 125 of the head 120. The pump 300 comprises a first check valve 301, a second check valve 302 downstream from the first check valve 301, and a chamber 305 of variable volume between the first and second check valves 301, 302. That is, the first check valve 301 is downstream of the reservoir 400 and upstream of the chamber 305, the chamber 305 is downstream of the first check valve 301 and upstream of the second check valve 302, and the second check valve 302 is downstream of the chamber 305 and upstream of the fluid outlet 125. The first check valve 301 can be considered an inlet check valve, since it is through the first check valve 301 that oral care fluid is introduced into the chamber 305 from the reservoir 400. The second check valve 302 can be considered an outlet check valve, since it is through the second check valve 302 that oral care fluid is delivered out from the chamber 305 towards the fluid outlet 125.

Figure 3:
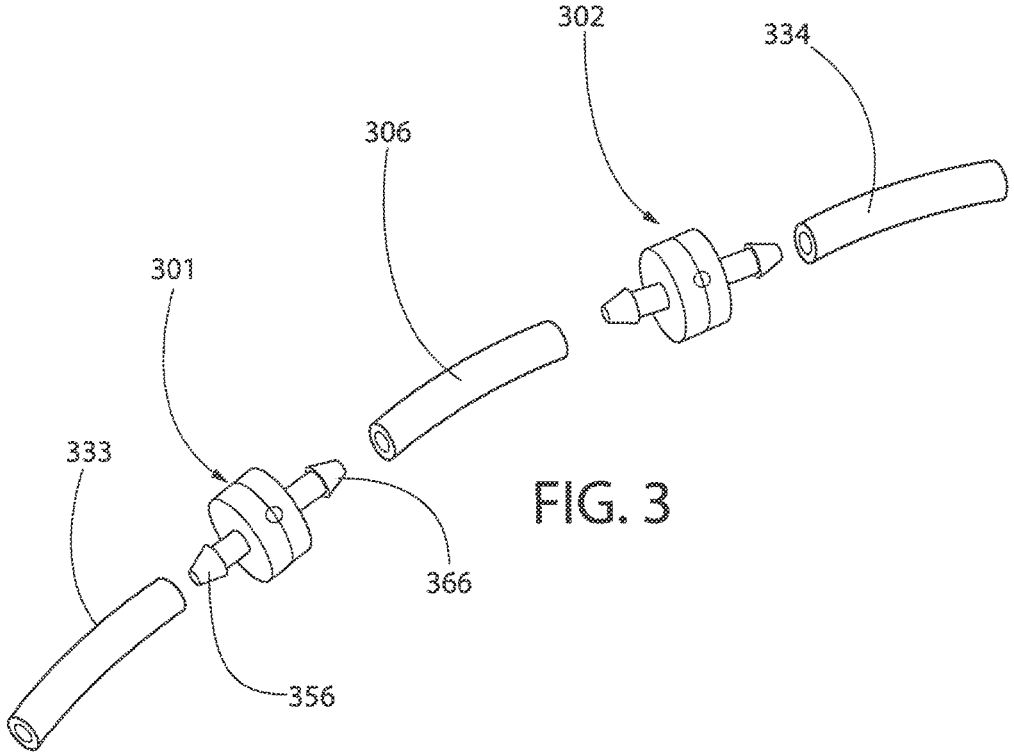
FIG. 3 shows an exploded view of components of the pump of the oral care implement of FIG. 1.

The reservoir 400 is fluidly connected to the first check valve 301 by a first passageway 331, and the second check valve 302 is fluidly connected to the fluid outlet 125 by a second passageway 332. In the illustrated embodiment, the first passageway 331 is defined by a, preferably flexible, dip tube 333 that extends from the reservoir 400 through the body 100 to the first check valve 301. Also, in the illustrated embodiment, the second passageway 332 is defined by a, preferably flexible, pipe 334 that extends from the second check valve 302 through the neck portion 118 of the body 100 towards the fluid outlet 125. Also, in the illustrated embodiment, the chamber 305 is defined by a flexible vessel 306 inside the handle 110 of the body 100. These components, and their relative positions, can be seen in FIGS. 1 and 3. In variations to the illustrated embodiment, some or a majority of the first passageway 331 may be defined by material of the body 100 and/or some or a majority of the second passageway 332 may be defined by material of the body 100.

The fluid outlet 125 may be of any form known in the art. The fluid outlet 125 may permanently permit fluid communication from the exterior of the toothbrush 1 to the second passageway 332, or the fluid outlet 125 may comprise a valve, such as a check valve, e.g. a duck bill valve, that permits fluid flow from the second passageway 332 to the exterior of the toothbrush 1 and restricts or prevents fluid flow from the exterior of the toothbrush 1 to the second passageway 332. Optionally, the fluid outlet 125 includes a spray or atomizer nozzle for causing the oral care fluid to be emitted as one of a spray, a mist, and a stream. Such a nozzle optionally causes the oral care fluid to be emitted in the form of droplets having an average diameter of less than 500 microns, or less than 400 microns, or less than 300 microns, or less than 200 microns, or less than 150 microns.

Figure 4:
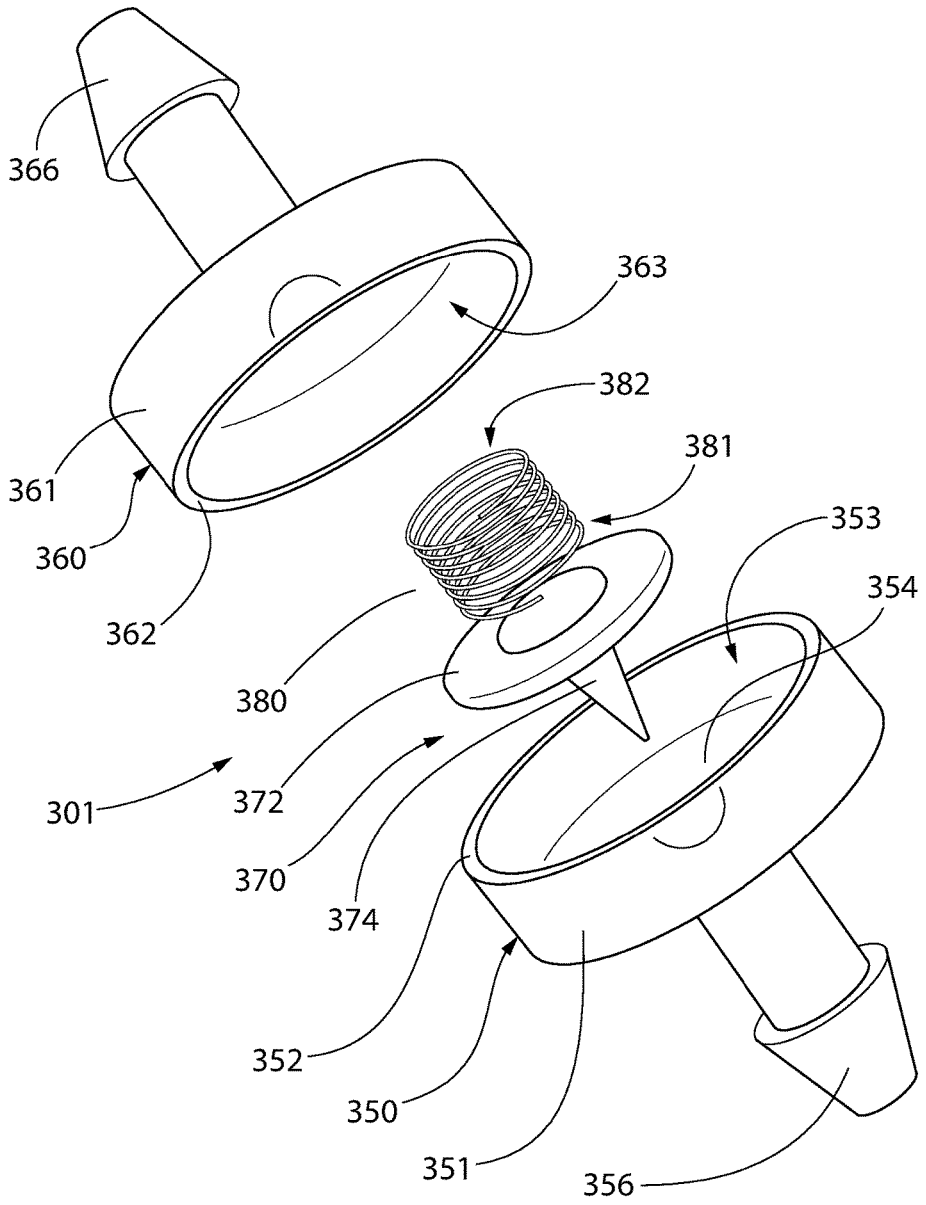
FIGS. 4 and 5 show exploded views of components of the first check valve of the pump of the oral care implement of FIG. 1.

As best shown in FIG. 4, the first check valve 301 comprises a first valve seat 354 defining a first opening (not shown) through which oral care fluid is flowable from the reservoir 400 towards the chamber 305. The first check valve 301 also comprises a first valve member 370 that is separate from the first valve seat 354, that comprises a first stopper 372 that is movable linearly relative to the first valve seat 354, and that is for blocking or restricting fluid flow through the first opening. In some embodiments, the first stopper 372 comprises a plug for plugging the first opening so as to block or restrict fluid flow through the first opening. In other embodiments, the first stopper 372 comprises a cover for covering the first opening so as to block or restrict fluid flow through the first opening. The first valve seat 354 and a perimeter of the first stopper 372 may be of the same shape. In embodiments in which the first stopper 372 comprises a plug for plugging the first opening, the provision of such same shapes helps create a good seal between the first stopper 372 and the first valve seat 354 when the first stopper 372 is blocking the first opening. In the present embodiment, each of the first valve seat 354 and the perimeter of the first stopper 372 is circular. In the present embodiment, the first stopper 372 is resilient and/or flexible, in order to help the first stopper 372 conform to the shape of the first valve seat 354 to create a good seal between the first stopper 372 and the first valve seat 354 when the first stopper 372 is blocking the first opening. In other embodiments, the first stopper 372 may be substantially rigid. Although the illustrated first stopper 372 may also be movable relative to the first valve seat 354 in manners other than linearly, such as by rotating about a point at which the first stopper 372 contacts the first valve seat 354, nevertheless the first stopper 372 is movable linearly relative to the first valve seat 354. In some embodiments, the first stopper 372 is constrained to movement relative to the first valve seat 354 that is linear.

The first valve member 370 comprises a first stem 374 extending from the first stopper 372 and, when the first check valve 301 is fully assembled, the first stem 374 is movably located in the first opening so as to help locate the first valve member 370 relative to the first opening and to restrict movement of the first valve member 370 relative to the first opening to linear movement. In the illustrated embodiment, the first stem 374 is unitary with the first stopper 372, but in other embodiments the first stem 374 may be separate from the first stopper 372. Herein, by "unitary" it is meant integrally formed with, so as together to be just one piece. Herein, by "separate" it is meant discrete, distinct components that are not unitary or integrally formed. Nevertheless, in embodiments where the first stem 374 is separate from the first stopper 372, the first stem 374 and the first stopper 372 may contact each other and be connected together. In the illustrated embodiment, the first stem 374 is tapered, so that its cross-sectional area reduces with distance from the first stopper 372, in order to aid location of the first stem 374 in the first opening during assembly and to aid fluid flow past the first stem 374 during operation of the pump 300. In variations to the illustrated embodiment, the first stem 374 may not be tapered.

The first check valve 301 also comprises a first resilient element 380 which, when the first check valve 301 is fully assembled, biases the first stopper 372 towards the first valve seat 354 to block or restrict fluid flow through the first opening. The first stopper 372 is movable between a first position, at which the first stopper 372 blocks the first opening, and a second position, at which the first opening is not blocked by the first stopper 372. The first resilient element 380 biases the first stopper 372 to the first position. In the illustrated embodiment, the first resilient element 380 comprises a compression spring, in the form of a helical or coil spring, for pushing the first stopper 372 towards the first valve seat 354, i.e. towards the first position. In other embodiments, the first resilient element 380 may comprise a different form of compression spring, such as a leaf spring. In some embodiments, the first resilient element 380 may be a tension spring arranged for pulling the first stopper 372 towards the first valve seat 354, i.e. towards the first position. In the illustrated embodiment, the first resilient element 380 is separate from the first valve member 370, but in other embodiments the first resilient element 380 may be unitary with the first valve member 370. Since the first resilient element 380 is separate from the first valve member 370, the first resilient element 380 and the first valve member 370 can be manufactured from respective different materials that are optimum or particularly adapted to carry out the respective roles of the first resilient element 380 and the first valve member 370 without impacting the performance of the other of the first resilient element 380 and the first valve member 370. Thus, the first resilient element 380 can be manufactured from a material with a suitable spring constant to permit effective and reliable control of fluid flow through the first check valve 301, and the first valve member 370 can be manufactured from a durable material with suitable characteristics to seal the first opening when the first check valve 301 is closed. The first resilient element 380 may be made from a metal, such as spring steel. The first valve member 370 may be made from a metal or a plastic, such as a thermoplastic polymer, e.g. polyethylene terephthalate (PET) or polypropylene (PP). The first valve member 370 may be made from an elastomer, such as a thermoplastic elastomer (TPE) or silicone. The spring constant of the first resilient element 380 may be at least 10 N/m, at least 25 N/m, at least 50 N/m, at least 75 N/m, or at least 100 N/m.

Figure 5:
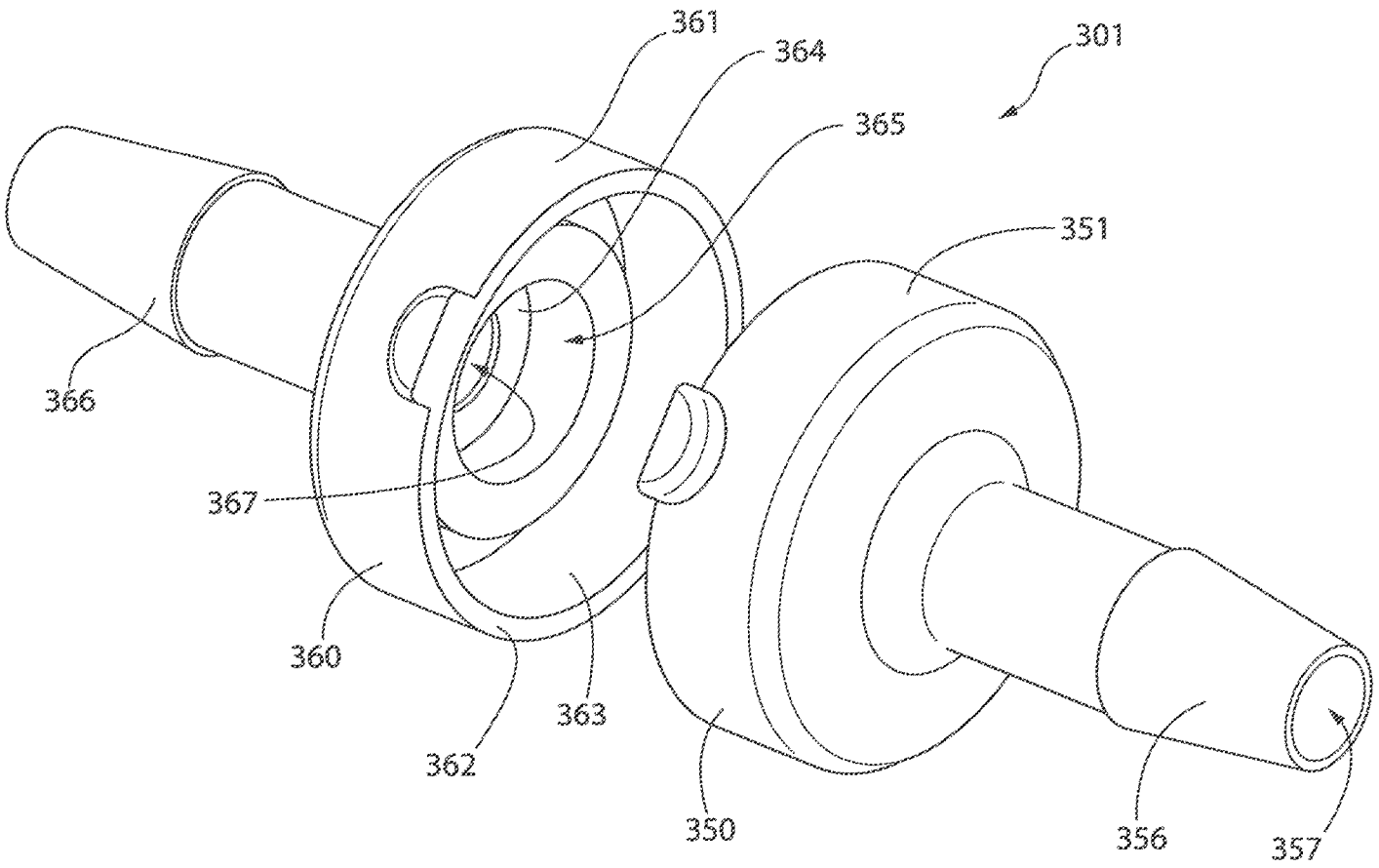
Figure 6:
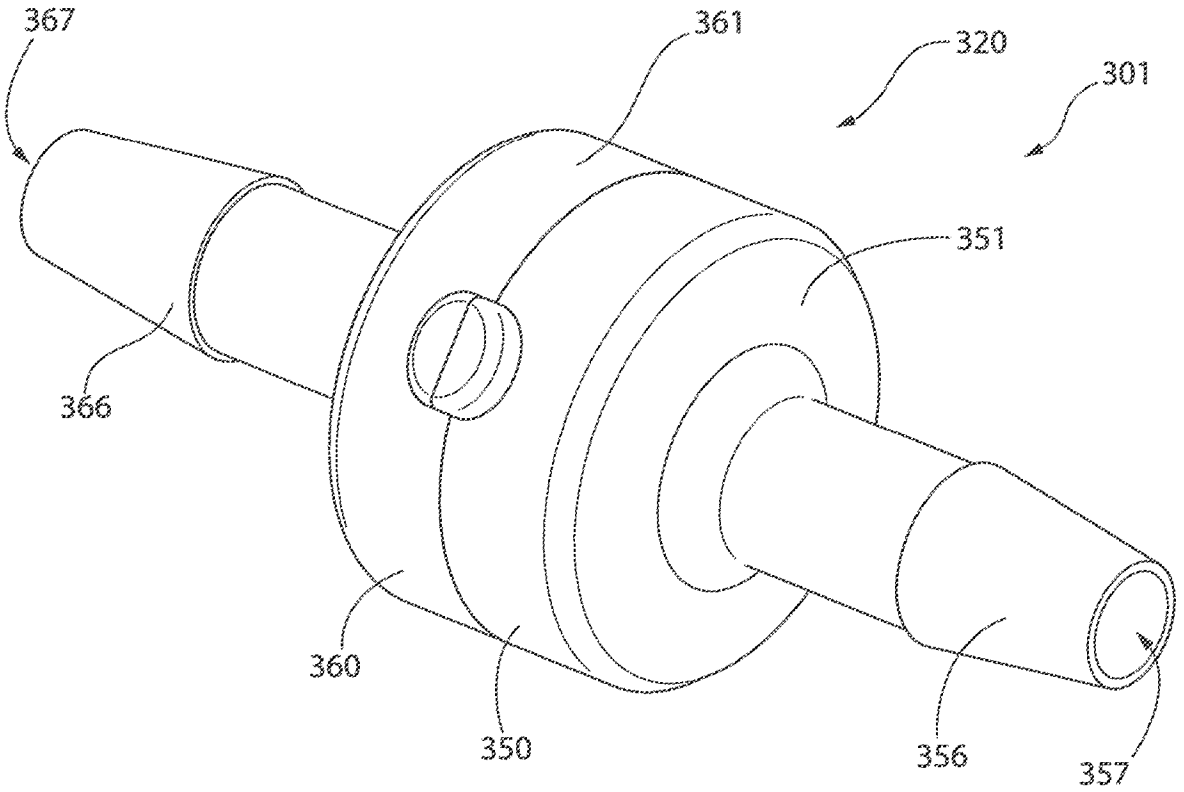
FIG. 6 shows the first check valve of FIGS. 4 and 5 when assembled.

As best shown in FIGS. 4 to 6, the first check valve 301 further comprises a first casing 320 within which the first stopper 372 and the first resilient element 380 are located. The first casing 320 is non-unitary with the body 100 and is located within the body 100, as best shown in FIG. 1. The first casing 320 comprises a first casing part 350 and a second casing part 360 attachable (attached, when the first check valve 301 is fully assembled) to the first casing part 350 so as to encase the first stopper 372 and the first resilient element 380 in the first casing 320. Each of the first and second casing parts 350, 360 comprises a cup-shaped portion 351, 361 with a rim 352, 362 defining an opening into an interior cavity 353, 363 of the respective cup-shaped portion 351, 361. During assembly of the first check valve 301, the first and second casing parts 350, 360 are affixed to each other with the rims 352, 362 in contact with each other to create a seal therebetween, so that the interior cavities 353, 363 together define a hollow interior of the first check valve 301 within which the first stopper 372 and the first resilient element 380 are located. The first and second casing parts 350, 360 may be affixed to each other in any suitable manner, such as by adhesion or welding or by a mechanical connection, such as a friction fit, a snap fit, a bayonet connection, a threaded connection, or one or more clips.

The first valve seat 354 is defined by the first casing 320, and more specifically by the first casing part 350. An end of the first resilient element 380 abuts a surface 364 of the first casing 320. More specifically, a first end 381 of the first resilient element 380 abuts the first stopper 372 and a second end 382 of the first resilient element 380 abuts an interior surface 364 of the second casing part 360. The surface 364 of the first casing 320, i.e. the interior surface 364 of the second casing part 360, is in a recess 365 in the second casing part 360. The first resilient element 380 can be considered to resiliently connect the interior surface 364 of the second casing part 360 with the first stopper 372, and to bias the first stopper 372 away from the interior surface 364 of the second casing part 360 and towards the first valve seat 354 defined by the first casing part 350.

The first casing part 350 further comprises a first protrusion 356 extending from an exterior of the cup-shaped portion 351 and defining a first lumen 357 therein. The first lumen 357 is fluidly connected with the first opening defined by the first valve seat 354, so that the interior cavity 353 of the cup-shaped portion 351 of the first casing part 350 is fluidly connected with the first lumen 357. On assembly of the toothbrush 1, an end of the dip tube 333 is push-fitted onto the first protrusion 356 to place the first lumen 357, and thus the hollow interior of the first check valve 301, in fluid communication with the first passageway 331 and, ultimately, with the reservoir 400, as can be appreciated from FIGS. 1 and 3.

The second casing part 360 further comprises a second protrusion 366 extending from an exterior of the cup-shaped portion 361 and defining a second lumen 367 therein. The second lumen 367 is fluidly connected with an opening in the cup-shaped portion 361 of the second casing part 360, so that the interior cavity 363 of the cup-shaped portion 361 of the second casing part 360 is fluidly connected with the second lumen 367. On assembly of the toothbrush 1, a first end of the flexible vessel 306 defining the chamber 305 is push-fitted onto the second protrusion 366 to place the second lumen 367, and thus the hollow interior of the first check valve 301, in fluid communication with the chamber 305, as can be appreciated from FIGS. 1 and 3.

The second check valve 302 comprises the same components as the first check valve 301, and differs from the first check valve 301 only (a) in the spring constant of a second resilient element that corresponds to the first resilient element 380 of the first check valve 301, and (b) in the components to which the second check valve 302 is connected, as described in more detail below.

Thus, the second check valves 302 comprises a second valve seat defining a second opening through which the oral care fluid is flowable, a second valve member comprising a second stopper, and the second resilient element biasing the second stopper towards the second valve seat to block or restrict fluid flow through the second opening. The second valve member is separate from the second valve seat, and the second stopper is movable linearly relative to the second valve seat and has a free edge along a full perimeter of the second stopper.

The spring constant of the first resilient element 380 of the first check valve 301 is less than the spring constant of the second resilient element of the second check valve 302. Accordingly, the resistance to flow of the oral care fluid through the second check valve 302 is greater than the resistance to flow of the oral care fluid through the first check valve 301. Thus, oral care fluid can be relatively easily drawn into the chamber 305 of the pump 300 during operation of the pump 300, but the oral care fluid in the chamber 305 is unlikely to pass through the second check valve 302 towards the fluid outlet 125 during periods of non-operation of the pump 300, such as when the toothbrush 1 is in storage. In variations to the illustrated embodiment, the spring constant of the first resilient element 380 of the first check valve 301 is more than the spring constant of the second resilient element of the second check valve 302, or the spring constant of the first resilient element 380 of the first check valve 301 is substantially the same as the spring constant of the second resilient element of the second check valve 302. The spring constant of the second resilient element may be at least 10 N/m, at least 25 N/m, at least 50 N/m, at least 75 N/m, or at least 100 N/m.

As best shown in FIG. 1, the second check valve 302 further comprises a second casing within which the second stopper and the second resilient element are located. The second casing is non-unitary with the body 100 and is located within the body 100. The second casing comprises a first casing part 390 and a second casing part 395 attachable (attached, when the second check valve 302 is fully assembled) to the first casing part 390 so as to encase the second stopper and the second resilient element in the second casing. The first and second casing parts 390, 395 of the second check valve 302 are identical to the first and second casing parts 350, 360 of the first check valve 301, and so will not be described in detail for conciseness.

The first casing part 390 of the second check valve 302 comprises a first protrusion 391 extending from an exterior of a cup-shaped portion of the first casing part 390 and defining a third lumen therein. The third lumen in the first protrusion 391 is fluidly connected with the second opening defined by the second valve seat, so that an interior cavity of the cup-shaped portion of the first casing part 390 is fluidly connected with the third lumen. On assembly of the toothbrush 1, a second end of the flexible vessel 306 defining the chamber 305 is push-fitted onto the first protrusion 391 to place the third lumen, and thus the hollow interior of the second check valve 302, in fluid communication with the chamber 305, as can be appreciated from FIGS. 1 and 3.

The second casing part 395 of the second check valve 302 comprises a second protrusion 396 extending from an exterior of a cup-shaped portion of the second casing part 395 and defining a fourth lumen therein. The fourth lumen is fluidly connected with an opening in a cup-shaped portion of the second casing part 395, so that an interior cavity of the cup-shaped portion of the second casing part 395 is fluidly connected with the fourth lumen. On assembly of the toothbrush 1, an end of the pipe 334 is push-fitted onto the second protrusion 396 to place the fourth lumen, and thus the hollow interior of the second check valve 302, in fluid communication with the fluid outlet 125, as can be appreciated from FIGS. 1 and 3.

The pump 300 comprises a diaphragm pump. As mentioned above, the chamber 305 of the pump 300 is of variable volume. A wall of the chamber 305 comprises a resilient movable diaphragm 312. The movable diaphragm 312 may be made from an elastomer, such as a thermoplastic elastomer (TPE) or silicone. The movable diaphragm 312 is operably connected to the user-operable actuator 310 for a user to operate the pump 300 to pump oral care fluid from the reservoir 400 to the fluid outlet 125. In the illustrated embodiment, the toothbrush 1 comprises a thumb grip surface 311 on the first, front side of the toothbrush 1, more specifically on a first, front side 113 of the handle 110, and the thumb grip surface 311 is a surface of the user-operable actuator 310, so that the thumb grip surface 311 is operably connected to the movable diaphragm 312. On a second, rear side of the toothbrush 1, more specifically on a second, rear side 114 of the handle 110, the toothbrush 1 may comprise a second grip surface. During use of the toothbrush 1, a user most comfortably holds the toothbrush 1 with the handle 110 lying in the palm of their hand, with their thumb on the thumb grip surface 311, and with their index and/or middle finger on the optional second grip surface. The thumb grip surface 311, and the rest of the user-operable actuator 310, is movable relative to the body 100 to cause movement of the movable diaphragm 312, which causes a change in volume of the chamber 305 and thus operation of the pump 300. In some embodiments, the thumb grip surface 311 is a surface of the movable diaphragm 312, or is otherwise unitary with the movable diaphragm 312. In such embodiments, the movable diaphragm 312 may be made from an elastomer, such as a thermoplastic elastomer (TPE) or silicone.

Operation of the illustrated toothbrush 1 will now be described. Preferably, a user applies a dentifrice to the oral care elements 200 and then uses the dentifrice and the oral care elements 200 to brush their teeth. In order to benefit from the effects of the oral care fluid in the reservoir 400, before, during or after brushing their teeth, while holding the head 120 in their oral cavity, the user applies a force F (see FIG. 1) onto the thumb grip surface 311 in a direction substantially towards a longitudinal axis A-A of the toothbrush 1. Application of the force F causes the user-operable actuator 310 to apply pressure to the movable diaphragm 312, thereby to reduce the volume of the chamber 305. The reduction in volume of the chamber 305 increases pressure of fluid in the chamber 305. As will be appreciated by the skilled person, the increased pressure of the fluid in the chamber 305 causes the fluid in the chamber 305 to apply a force to the second stopper of the second check valve 302 to overcome the resilience of the second resilient element of the second check valve 302. The second check valve 302 thus opens (i.e. the second stopper moves to its second position), and the fluid in the chamber 305 passes through the second check valve 302 into the second passageway 332. Meanwhile, the first check valve 301 remains closed (i.e. the first stopper 370 remains at its first position), because the pressure in the chamber 305 is greater than that in the first passageway 331. The second check valve 302 remains open until the pressure in the chamber 305 and the pressure in the second passageway 332 are substantially equal, at which point the second check valve 302 closes (i.e. the second stopper returns to its first position) due to the resilience of the second resilient element.

When the user subsequently reduces or removes the force F, the resilience of the diaphragm 312 causes the diaphragm 312 to move back to its original position, thereby to increase the volume of the chamber 305 and correspondingly reduce the pressure of fluid in the chamber 305. Initially, during this movement of the diaphragm 312, both the first and second check valves 301, 302 are closed. However, once the pressure of fluid in the chamber 305 drops to below the pressure of fluid in the first passageway 331, the higher pressure of the fluid in the first passageway 331 causes the fluid in the first passageway 331 to apply a force to the first stopper 372 of the first check valve 301 to overcome the resilience of the first resilient element 380. The first check valve 301 thus opens (i.e. the first stopper 370 moves to its second position), and the fluid in the first passageway 331, comprising oral care fluid from the reservoir 400, passes through the first check valve 301 into the chamber 305. Meanwhile, the second check valve 302 remains closed (i.e. the second stopper remains at its first position), because the pressure in the second passageway 332 is greater than that in the chamber 305. Once the pressure in the chamber 305 and the pressure in the first passageway 331 are substantially equal, the resilience of the first resilient element 380 of the first check valve 301 causes the first check valve 301 to close (i.e. the first stopper 370 returns to its first position). As will be understood by the skilled person, by reapplying the force F, the oral care fluid now in the chamber 305 passes through the second check valve 302. Repeated application and removal of the force F causes a net movement of the oral care fluid from the reservoir 400 to the fluid outlet 125 and the exterior of the toothbrush 1.

In contrast to a known flap valve, since the first valve member 370 of the first check valve 301 is separate from the first valve seat 354, there is no unitary element connecting the first valve member 370 directly to the first valve seat 354 that could deteriorate over time, particularly if subjected to high temperatures. Moreover, since the first stopper 370 is movable linearly relative to the valve seat 354, rather than necessarily being constrained to rotational movement about a hinge for example, the first valve member 370 has a simple construction that exposes a large area of the first opening on initial movement of the first stopper 370 from the first valve seat 354, leading to improved flow through the first check valve 301. Still further, since the first resilient element 380 is separate from the first valve member 370, the first resilient element 380 and the first valve member 370 can be manufactured from respective different materials that are optimum or particularly adapted to carry out the respective roles of the first resilient element 380 and the first valve member 370 without impacting the performance of the other of the first resilient element 380 and the first valve member 370. Thus, the first resilient element 380 can be manufactured from a material with a suitable spring constant to permit effective and reliable control of fluid flow through the first check valve 301, and the first valve member 370 can be manufactured from a durable material with suitable characteristics to seal the first opening when the first check valve 301 is closed. Corresponding comments are applicable for the corresponding components of the second check valve 302. Also, this modular construction of the first and second check valves 301, 302 permits like components of the first and second check valves 301, 302 to be standardized and identical to one another, leading to cost and manufacturing efficiencies. The first and second check valves 301, 302 can be given different characteristics, such as different performance characteristics, just by varying the necessary component(s) thereof. For example, the first and second resilient elements may be provided with different spring constants, if required, to provide optimum operating characteristics of the pump 300.

Figure 7:
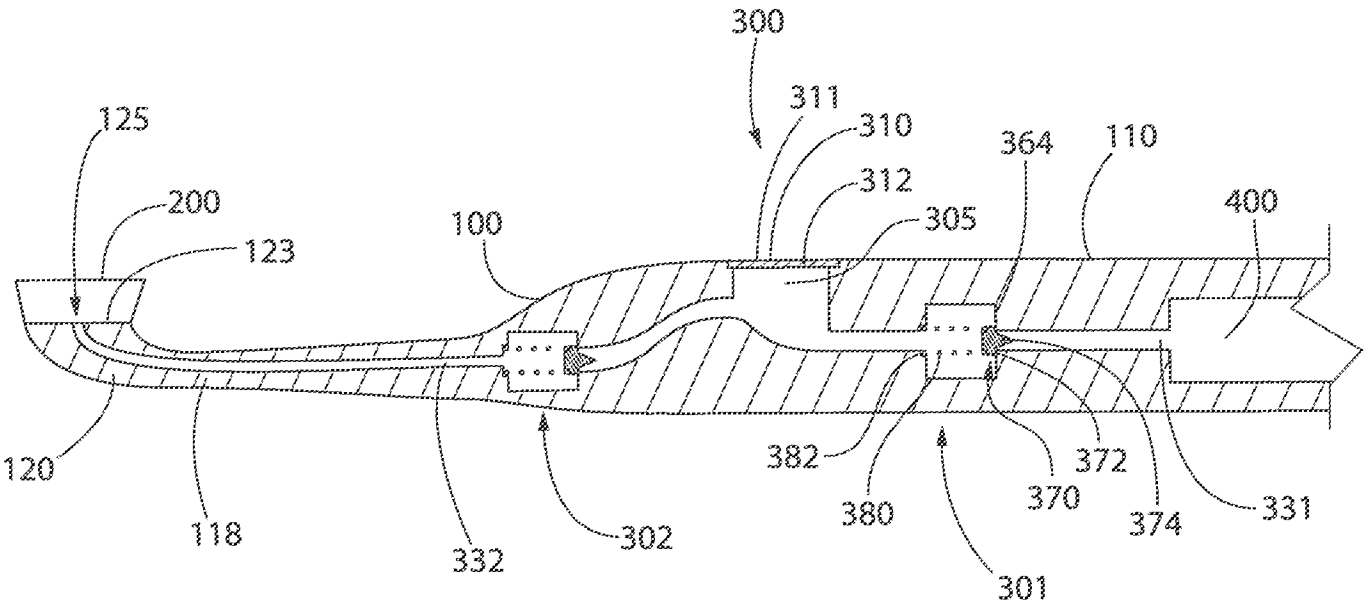
FIG. 7 shows a cross section view of an oral care implement according to another exemplary embodiment of the present invention.

In variations to the embodiment illustrated in FIGS. 1 to 6, the first and/or second casings of the first and second check valves 301, 302 may be omitted. In such variations, one or both of the first and second valve seats may be defined by a surface of the body 100. Moreover, in such variations, one or both of the surfaces that the respective second ends of the first and second resilient elements abut may be defined by a surface of the body 100. Still further, in such variations, some or a majority of one or both of the first and second passageways 331, 332 may be defined by material of the body 100. Furthermore, in such variations, the chamber 305 may be partially defined by material of the body 100. A cross section view of an embodiment of the present invention according to such a variation is shown in FIG. 7. Like elements shown in FIGS. 1 to 6 and in FIG. 7 are indicated with like numerals and will not be described again in the interests of conciseness. In the embodiment of FIG. 7, respective surfaces of the body 100 define the first and second valve seats, the surfaces 364 that the respective second ends 382 of the first and second resilient elements 380 abut, and the first and second passageways 331, 332. Moreover, the chamber 305 is partially defined by material of the body 100 and partially defined by the movable diaphragm 312. The thumb grip surface 311 is a surface of the movable diaphragm 312, which is made from an elastomer, such as a thermoplastic elastomer (TPE) or silicone. To the extent they are compatible, any optional features of the embodiment shown in FIGS. 1 to 6 described herein are optional features of the embodiment shown in FIG. 7.

In each of the illustrated embodiments, the first and second valves 301, 302 are substantially axially aligned. However, in respective variations to the illustrated embodiments, the first and second valves 301, 302 may be non-axially aligned. Non-axial alignment of the first and second valves 301, 302 is facilitated by having one or both of the first and second passageways 331, 332 defined by material of the body 100 or by flexible tubes/pipes. This permits greater design freedom when it comes to providing the oral care implement with an exterior shape.

In variations to the illustrated embodiments, the user-operable actuator 310 may be located elsewhere than as illustrated. For example, the user-operable actuator 310 may be located at the proximal end 111 of the handle 110 or in the neck portion 118 of the handle 110.

In variations to the illustrated embodiments, the reservoir 400 may take any known form. For example, the reservoir 400 may be comprised in a collapsible vessel, such as a collapsible bag or bellows in the body 100, in which case the body 100 preferably includes a vent fluidly connecting an exterior of the collapsible vessel to the exterior of the toothbrush 1, or the reservoir 400 may be comprised in a vessel including a piston separating the oral care fluid from a vented side of the piston.

In variations to the illustrated embodiments, the reservoir 400 may be provided elsewhere in the body 100 than at the position shown in the Figures. For example, the reservoir 400 may be provided in or adjacent to the neck portion 118 of the handle 110, or in the head 120 of the body 100. In some variations to the illustrated embodiments, the reservoir 400 may extend into both the handle 110 and the head 120 of the body 100.

What is claimed is:

1. An oral care implement, comprising:

a body comprising a handle, a head at an end of the handle, and at least one fluid outlet, the head having at least one oral care element extending therefrom;

a reservoir, in the body, for storing an oral care fluid; and a pump for pumping the oral care fluid from the reservoir towards the fluid outlet, wherein the pump comprises a first check valve downstream of the reservoir, and a second check valve downstream of the first check valve and upstream of the fluid outlet;

wherein one of the first and second check valves comprises a valve seat defining an opening through which the oral care fluid is flowable, a valve member separate from the valve seat and comprising a stopper movable linearly relative to the valve seat, and a resilient element biasing the stopper towards the valve seat to restrict fluid flow through the opening;

wherein the one of the first and second check valves comprises a casing within which the stopper and resilient element are located; and wherein an end of the resilient element abuts a surface of the casing, and wherein the surface of the casing is in a recess in the casing.

2. The oral care implement of claim 1, wherein the resilient element is unitary with the valve member, or wherein the resilient element is separate from the valve member.

3. The oral care implement of claim 1, wherein the valve member comprises a stem extending from the stopper and movably located in the opening, and wherein the stem is unitary with the stopper.

4. The oral care implement of claim 1, wherein the stopper comprises a plug for plugging the opening.

5. The oral care implement of claim 1, wherein the resilient element comprises at least one of a compression spring and a helical spring.

6. The oral care implement of claim 1, wherein the valve seat is defined by a surface of the body.

7. The oral care implement of claim 1, wherein the casing is non-unitary with the body and is located within the body.

8. The oral care implement of claim 1, wherein the pump comprises a chamber of variable volume downstream of the first check valve and upstream of the second check valve.

9. The oral care implement of claim 1, wherein the other of the first and second check valves comprises a second valve seat defining a second opening through which the oral care fluid is flowable, a second valve member comprising a second stopper, and a second resilient element biasing the second stopper towards the second valve seat to restrict fluid flow through the second opening.

10. The oral care implement of claim 9, wherein the one of the first and second check valves is the first check valve, the other of the first and second check valves is the second check valve, and wherein a spring constant of the resilient element of the first check valve is less than a spring constant of the second resilient element of the second check valve.

11. The oral care implement of claim 9, wherein the second valve member is separate from the second valve seat.

12. The oral care implement of claim 9, wherein the second stopper is movable linearly relative to the second valve seat.

13. The oral care implement of claim 9, wherein the second stopper has a free edge along a full perimeter of the second stopper.

14. An oral care implement, comprising:

a body comprising a handle, a head at an end of the handle, and at least one fluid outlet, the head having at least one oral care element extending therefrom;

a reservoir, in the body, for storing an oral care fluid; and a pump for pumping the oral care fluid from the reservoir towards the fluid outlet, wherein the pump comprises a first check valve downstream of the reservoir, and a second check valve downstream of the first check valve and upstream of the fluid outlet;

wherein one of the first and second check valves comprises a valve seat defining an opening through which the oral care fluid is flowable, a valve member comprising a stopper movable relative to the valve seat, and a resilient element separate from the valve member and biasing the stopper towards the valve seat to restrict fluid flow through the opening;

wherein the one of the first and second check valves comprises a casing within which the stopper and resilient element are located; and wherein the casing is non-unitary with the body and is located within the body.

15. The oral care implement of claim 14, wherein the valve member is separate from the valve seat.

16. The oral care implement of claim 14, wherein the stopper is movable linearly relative to the valve seat.

17. The oral care implement of claim 14, wherein an end of the resilient element abuts a surface of the casing, and wherein the surface of the casing is in a recess in the casing.

18. An oral care implement comprising:

a body comprising a handle, a head at an end of the handle, and at least one fluid outlet, the head having at least one oral care element extending therefrom;

a reservoir, in the body, for storing an oral care fluid; and a pump for pumping the oral care fluid from the reservoir towards the fluid outlet, wherein the pump comprises a first check valve downstream of the reservoir, and a second check valve downstream of the first check valve and upstream of the fluid outlet;

wherein one of the first and second check valves comprises a valve seat defining an opening through which the oral care fluid is flowable, a valve member separate from the valve seat and comprising a stopper movable linearly relative to the valve seat, and a resilient element biasing the stopper towards the valve seat to restrict fluid flow through the opening;

wherein the one of the first and second check valves comprises a casing within which the stopper and resilient element are located; and wherein the casing comprises a first casing part and a second casing part attached to the first casing part so as to encase the stopper and the resilient element in the casing.

19. The oral care implement of claim 18, wherein the first casing part defines the valve seat and an end of the resilient element abuts a surface of the second casing part.

* * * * *